US008132343B2

(12) United States Patent
Bollard et al.

(10) Patent No.: US 8,132,343 B2
(45) Date of Patent: Mar. 13, 2012

(54) SPORTS BOOT WITH BLOCKING DEVICE

(75) Inventors: Patrick Bollard, Veyrier du Lac (FR); Tiziano Posato, Maser (IT)

(73) Assignee: Salomon S.A.S., Metz-Tessy (FR)

( * ) Notice: Subject to any disclaimer, the term of this patent is extended or adjusted under 35 U.S.C. 154(b) by 566 days.

(21) Appl. No.: 12/333,760

(22) Filed: Dec. 12, 2008

(65) Prior Publication Data

US 2009/0178304 A1 Jul. 16, 2009

(30) Foreign Application Priority Data

Dec. 14, 2007 (FR) ..... 07 08747

(51) Int. Cl.
*A43B 5/04* (2006.01)

(52) U.S. Cl. ..... 36/118.7; 36/118.8

(58) Field of Classification Search ..... 36/118.7, 36/118.8, 118.2, 117, 118.3, 118.4
See application file for complete search history.

(56) References Cited

U.S. PATENT DOCUMENTS

| | | | | | |
|---|---|---|---|---|---|
| 4,265,034 | A | | 5/1981 | Salomon | |
| 4,499,676 | A | * | 2/1985 | Chalmers, II | 36/118.7 |
| 4,761,899 | A | | 8/1988 | Marxer | |
| 4,788,781 | A | | 12/1988 | Benoit et al. | |
| 4,790,081 | A | | 12/1988 | Benoit et al. | |
| 4,821,433 | A | * | 4/1989 | Marxer | 36/118.7 |
| 4,839,973 | A | * | 6/1989 | Dodge | 36/118.7 |
| 5,136,794 | A | * | 8/1992 | Stampacchia et al. | 36/118.7 |
| 5,457,899 | A | | 10/1995 | Chemello | |
| 5,461,802 | A | | 10/1995 | Paris et al. | |
| 5,487,227 | A | * | 1/1996 | Marmonier | 36/117.1 |
| 5,588,229 | A | * | 12/1996 | Marmonier | 36/118.9 |
| 5,598,646 | A | | 2/1997 | Paris | |
| 5,651,199 | A | | 7/1997 | Chaigne et al. | |
| 5,857,271 | A | | 1/1999 | Pallatin | |
| 6,101,745 | A | * | 8/2000 | Grandin et al. | 36/118.7 |
| 6,263,593 | B1 | * | 7/2001 | Pierce et al. | 36/118.3 |
| 6,643,955 | B2 | * | 11/2003 | Pierce et al. | 36/118.3 |
| 7,963,050 | B2 | * | 6/2011 | Sartor et al. | 36/118.7 |
| 2009/0178304 | A1 | * | 7/2009 | Bollard et al. | 36/118.2 |

FOREIGN PATENT DOCUMENTS

| | | | |
|---|---|---|---|
| EP | 0 248 149 | A1 | 12/1987 |
| FR | 2 661 076 | A1 | 10/1991 |
| WO | WO-95/20888 | A1 | 8/1995 |

* cited by examiner

*Primary Examiner* — Ted Kavanaugh
(74) *Attorney, Agent, or Firm* — Greenblum & Bernstein, P.L.C.

(57) ABSTRACT

A boot that includes a shell base and a collar, an articulation provided between the collar and the shell base, such that the collar can pivot with respect to the shell base about an articulation axis, which is substantially perpendicular to the longitudinal axis, and further including a device for blocking the rearward rotation of the collar with respect to the shell base, the devices for blocking the rearward rotation including the following: a rocker mounted so as to rotate with respect to either the collar or the shell base, around a first pivot, the pivot being oriented along a first axis and the rocker having an elongated shape between an upper end and a lower end, and the first pivot being positioned in the vicinity of one of the two ends; a support base, positioned in the vicinity of the other of the ends, including a first support surface, which is capable of coming in contact with either the shell base or the collar; and a lever mounted so as to rotate with respect to the rocker around a second pivot, the second pivot being oriented along a second axis, parallel to the first axis, and the second pivot being positioned between the first pivot and the support base, the lever including an actuating palette and a cam surface.

22 Claims, 3 Drawing Sheets

SPORTS BOOT WITH BLOCKING DEVICE

CROSS-REFERENCE TO RELATED APPLICATION

This application claims priority under 35 U.S.C. §119 of French Patent Application No. 07.08747, filed on Dec. 14, 2007, the disclosure of which is hereby incorporated by reference thereto in its entirety.

BACKGROUND OF THE INVENTION

1. Field of the Invention

The invention is directed to a sports boot having a base or lower part, referred to as a shell base, and an upper part, referred to as a collar. More particularly, the invention is directed to a device that allows a blocking and an unblocking of the collar relative to the shell.

2. Background and Other Information

Devices of the aforementioned type are known in the prior art. For example, French Patent Application Publication No. 2 661 076, and family member U.S. Pat. No. 5,136,794, disclose a ski boot equipped with such a device.

In such boot, the blocking device is located in the rear zone of the boot and interacts between the collar portion and the shell base portion of the boot via a rocking element mounted on a pivot pin. The rocking element, affixed to the collar, in particular by means of its pivot, is provided to be capable of alternatively occupying two predetermined angular positions, one to oppose the pivoting of the collar with respect to the shell base in the front-to-rear direction, and the other to allow the collar to pivot freely in that direction. To this end, the rocking element has a support zone at the end of a free arm that extends downward on the side of its pivot and in correspondence with an abutment with which the shell base is provided. Thus, for a given angular position of the rocking element, its free arm cooperates with the abutment of the shell base via its support zone and pivotally blocks the collar in the front-to-rear direction; conversely, for another given angular position of the rocking element, its free arm retracts from the abutment of the shell base, and allows the collar to pivot in the front-to-rear direction.

The blocking device of this boot is satisfactory but has a mechanical weakness in the area of the pivot of the rocking element. Indeed, because the rocking element does not include a counter-support on its free arm, all of the forces to which the free arm is subjected are entirely taken up by its pivot pin. However, due to its cylindrical shape and its small diameter, the pivot pin offers resistance and a reduced support surface in particular in the location of its ends, which are encased in the upper, on both sides of the rocking element. Also, taking into account the intensity and the repeated occurrence of the forces directed in the front-to-rear direction during the sporting activity, it is often noted that the ends of the pivot and their housings become oval in the collar, which can be the origin of the breakage of the pivot pin in certain cases. Further, the intensity of the forces in the front-to-rear direction forces the pivot pin to bend until causing its permanent deformation, in particular when the collar of the boot has a large housing on the side opposite the support zone of the free arm of the rocking element, which cooperates with the abutment of the shell base.

Furthermore, the blocking device described in the aforementioned documents is particularly bulky, because the collar includes an enlargement, or cap, that covers the device.

Finally, the pivot pin is in the center of the rocking element, i.e., halfway between the support zone and the upper portion which is connected to the means allowing for the actuation. Consequently, the amplitude of movement of the actuating means must be equal to that which is necessary for disengaging from the support zone. This results, among other things, in making the device bulky.

SUMMARY OF THE INVENTION

The invention overcomes the disadvantages of the prior art. In particular, the invention provides a blocking device that ensures a good distribution of forces without the risk of damaging its components.

In addition, the invention provides a blocking device that is well-integrated into the structure of the boot.

Further, the invention provides a blocking device that is less bulky than the prior art.

Still further, the invention provides a device that is inexpensive to manufacture.

Further still, the invention provides a blocking device that requires few parts for its manufacture.

To these and other ends, the invention more particularly is directed to a boot that includes a shell base and a collar, an articulation provided between the collar and the shell base so that the collar can pivot with respect the shell base along an articulation axis that is perpendicular to, or substantially perpendicular to, the longitudinal axis of the boot, or the longitudinal vertical median plane of the boot (which extends in a direction between the front and rear of the boot), the boot further including a device for blocking the rearward rotation of the collar with respect to the shell base. The device for blocking the rearward rotation includes the following: a rocker that is rotationally mounted, with respect to either the collar or the shell base, around a first pivot, the first pivot being oriented along a first axis and the rocker having an elongated shape between an upper end and a lower end, and the first pivot being positioned in the vicinity of one of the ends; a support base, positioned in the vicinity of the other end including a first support surface, which is capable of coming in contact with either the shell base or the collar; and a lever rotationally mounted with respect to the rocker around a second pivot, the second pivot being oriented along a second axis parallel to that the first axis, and the second pivot being positioned between the first pivot and the support base, the lever including an actuation plate and a cam surface.

The invention also is directed to a boot that includes a shell base and a collar, articulation provided between the collar and the shell base so that the collar can pivot with respect to the shell base along an articulation axis that is perpendicular to, or substantially perpendicular to, the longitudinal axis or longitudinal median plane, and further including a device for blocking the rearward rotation of the collar with respect to the shell base, the device for blocking of the rearward rotation includes the following: a rocker rotationally mounted with respect to either the collar or the shell base, around a first pivot, the pivot being directed along a first axis A1 and the rocker having an elongated shape between an upper end E1 and a lower end E2, and the first pivot being positioned in the vicinity of one of the two ends E1 or E2; a support base, positioned in the vicinity of the other of the ends E2 or E1 including a first support surface, which is capable of coming in contact with either the shell base or the collar; and a lever rotatably mounted with respect to the rocker around a second pivot, the second pivot being oriented along a second axis A2 parallel to the first axis A1, and the second pivot being positioned between the first pivot and the support base, the lever including an actuation plate and a cam surface.

In one preferred embodiment, the rocker is rotationally mounted on the collar; the first pivot is positioned in the vicinity of the upper end E1 and the support base is positioned in the vicinity of the lower end E2.

The blocking device is capable of being in a blocking state in which it blocks the rearward rotation of the rotational movement of the collar with respect to the shell base, or in a release state, in which such rotation is not blocked.

Advantageously, the first support surface of the support base corresponds to the other of the ends E2 or E1, and the ratio between the distance d1 separating the first pivot from the first end E1 and the distance d4 separating the first pivot from the second end E2 is between 0.15 and 0.35 or, in a more particular embodiment, between 0.2 and 0.3. In one embodiment of the invention, this ratio is substantially equal to 0.23±0.02.

Advantageously, the ratio between the distance d2 separating the first pivot from the second pivot and the distance d4 separating the first pivot from the lower end E2 is between 0.2 and 0.5 or, in a more particular embodiment, between 0.3 and 0.4. In one embodiment of the invention, this ratio is substantially equal to 0.36±0.02.

Advantageously, the rocker can pivot between a blocking position in which, during the rearward rotational movement of the collar, the first support surface comes in contact with an edge arranged on the shall base, and a release position, in which the rocker does not block the rearward rotation of the collar, and the amplitude of the rotational movement of the rocker corresponds to an angle β whose value is between $3°<\beta<25°$ or, in a more particular embodiment, between $5°<\beta<15°$.

Advantageously, the blocking device further includes a return mechanism, which returns the blocking device to the blocking state. Such return mechanism can include a spring positioned in the area of the upper end E1.

Advantageously, the lever enables the blocking device to switch from the blocking state to the release state, when the plate of the lever is rotationally actuated by the user by an amplitude that corresponds to an angle α, whose value is between 90° and 160° or, in a more particular embodiment, between 120° and 150°. In one embodiment of the invention, the value of this angle is substantially equal to 135±2°.

Advantageously, the cam surface includes an initial portion located at a distance C1 from the second pivot, an end portion located at a distance C2 from the second pivot. When the devices are in the release state, the end portion is in support against the rolling surface and C1<C2<10 mm.

Advantageously, the support base includes a second support surface which, when the blocking device is in the blocking state, is capable of being in contact with an abutment arranged on the collar.

BRIEF DESCRIPTION OF DRAWINGS

The invention will be better understood from the description that follows, with reference to the annexed drawings, in which.

DETAILED DESCRIPTION OF THE INVENTION

Figure 1:
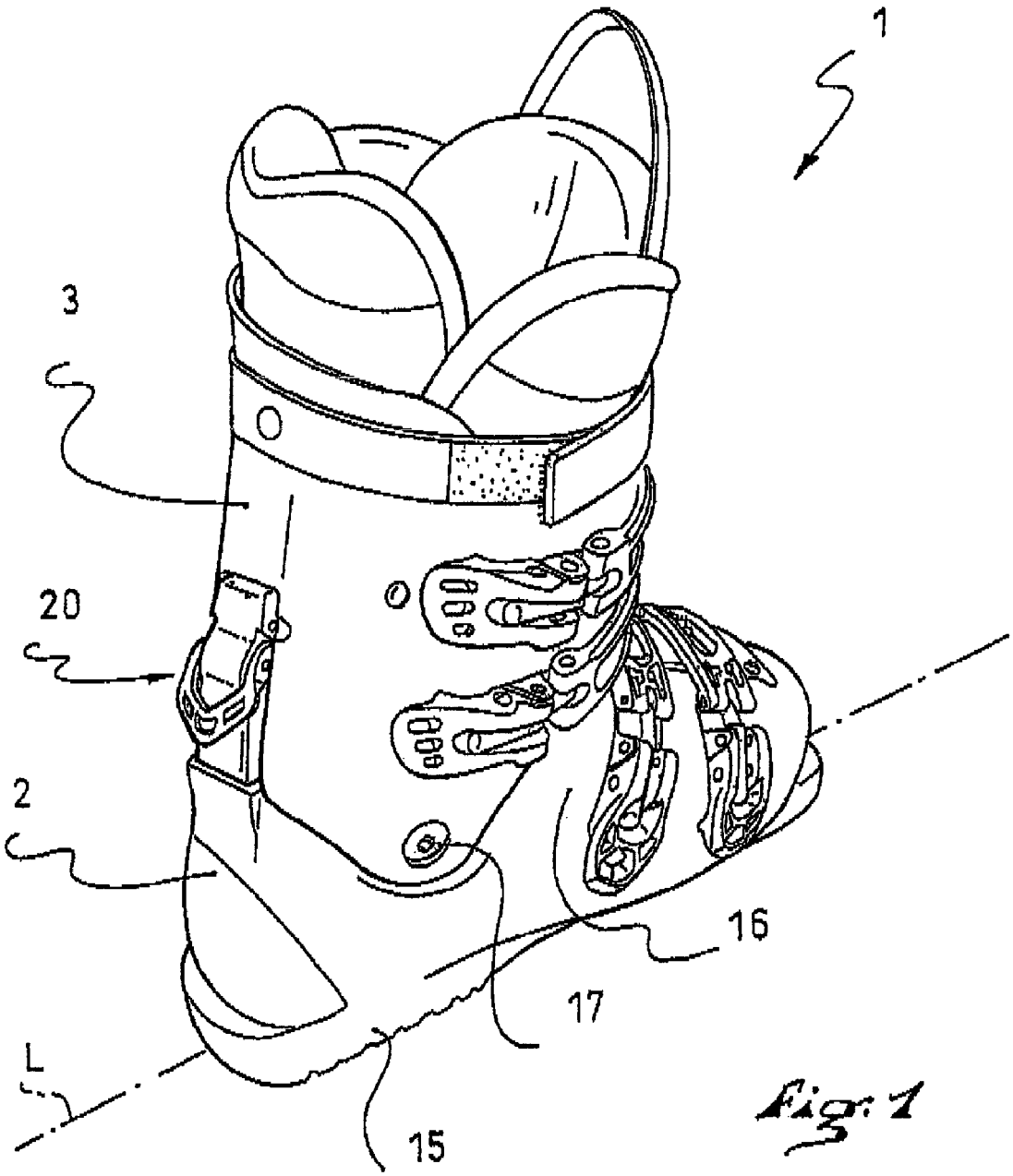
FIG. 1 is a perspective view of a boot according to one embodiment of the invention.

FIG. 1 shows a perspective view of a sports boot 1. This is a ski boot.

The invention encompasses any type of boot for which it is desirable, or necessary, to block movement of the upper, such as, for example, snowboard boots, mountaineering boots, and other types of boots.

The boot 1, oriented along the longitudinal axis L, which axis can be regarded as lying within a longitudinal median plane of the boot, includes a shell base 2 and a collar 3. The shell base 2 includes a sole 15, as well has sides 16 extending upwardly from the sole 15. The sides 16 define, together with the sole 15, a cavity that is provided to receive the user's foot. The upper portion of the shell base provides an opening used for inserting and withdrawing the foot. A collar 3 extends the shell base 2 in the direction of the user's leg. The collar 3 is fixed to the shell base 2 by means of two articulations 17, such as pins or rivets, e.g., that are opposite one another, i.e., one on the medial side of the boot, the other on the lateral side thereof. Connecting the collar 3 to the shell base 2 enables it to pivot along the axis defined by the two articulations, i.e., in the front-to-rear and rear-to-front directions. The pivoting of the collar 3 with respect to the shell base 2 has an amplitude less than 30°, or less than about 30°, and it enables the user to walk more easily. Indeed, when the user's foot is inserted in a boot which covers the ankle joint, movement of the ankle joint is blocked. The collar/shell base articulation returns a certain amount of front-to-rear freedom of movement for the ankle.

The shell base 2 and the collar 3 are generally made of synthetic materials, such as plastics. They are not necessarily made in a single piece, but can be made up of an assembly of various elements.

Certain sporting activities require the ankle joint to be immobilized, or at least limited in its amplitude of movement, as is the case with skiing and certain mountaineering activities. For this reason, the boot 1 is equipped with a blocking device 20, whose function is to block the articulation of the collar 3 with respect to the shell base 2.

The blocking device 20 is positioned in the rear zone of the boot 1. It is fixed to the collar 3 and acts on the shell base 2.

Other arrangements are encompassed by the invention, such as, e.g., an arrangement by which the blocking device 20 is positioned on the shell base 2 and acts on the collar 3.

The blocking device can be in the blocking state or in the release state; the latter can also be referred to as the released state.

In the released state, the device does not limit the rearward rotation of the collar 3 with respect to the shell base 2, and it does not prevent the forward rotation thereof. This is the "WALKING" position, in which the user must not only be able to bend forwards, he/she must also be able to make the ankle articulation pivot rearward each time he/she places the front foot on the ground. Therefore, the user needs the articulation of the ankle to function forward without limit.

On the other hand, in the "SKIING" position, the user must be able to take advantage of the firmest possible rear support. For this reason the rear support, i.e., the blocking of the rearward movement of the collar 3 with respect to the shell base 2, is provided in the form of abutments.

Figure 2:
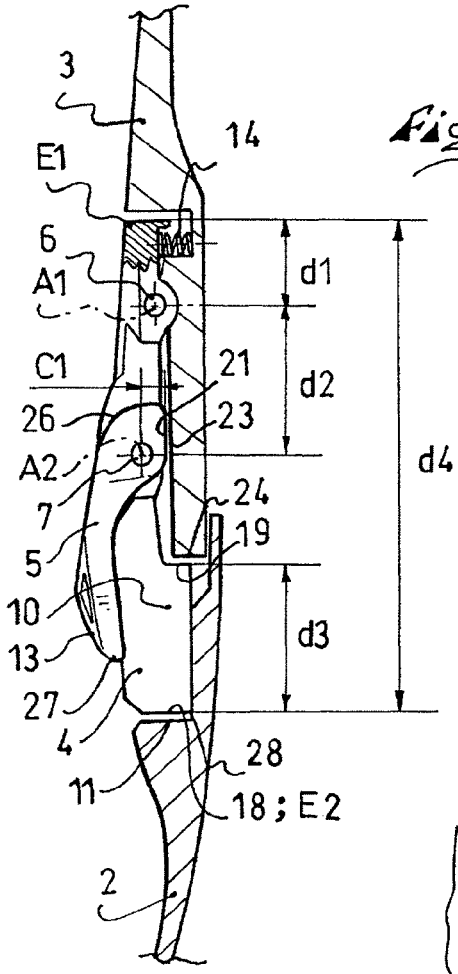
FIG. 2 is a cross-sectional side view of the blocking device of the boot of FIG. 1, when it is in the blocking state.
Figure 3:
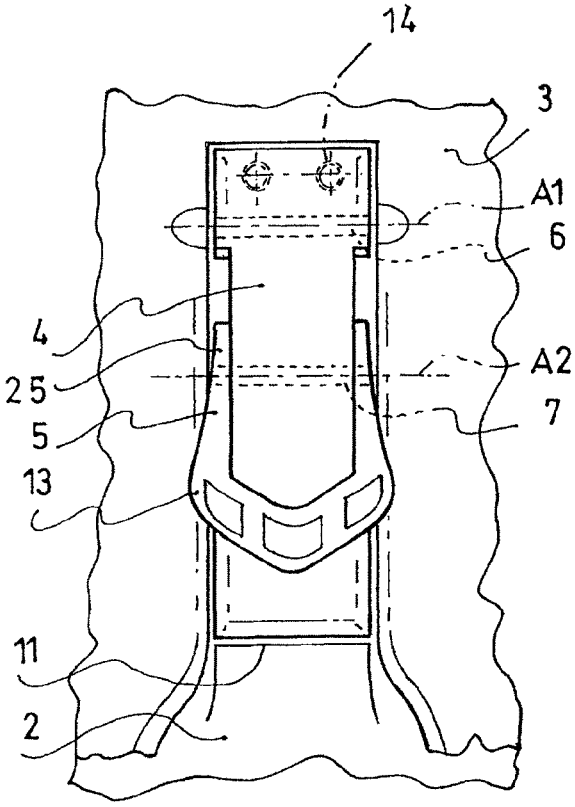
FIG. 3 is a rear view of the blocking device of the boot of FIG. 1, when it is in the blocking state.

FIGS. 2 and 3 are partial views of the boot illustrated in FIG. 1, when the blocking device is in the blocking state.

FIG. 2 is a partial cross-sectional view along a longitudinal plane of the boot.

FIG. 3 is a rear view of the boot.

With reference to FIG. 2, the rocker 4 is shown to be mounted on the collar 3 by means of a first pivot 6. The first pivot 6 is made by means of a shaft that can be a pin or a metal rod. The first pivot 6 is oriented along an axis A1, which is transverse to, or substantially transverse to, the boot.

The rocker 4 is in the form of an elongated element, which extends from an upper end E1, or first end, to a lower end E2, or second end. The rocker 4 further includes a support base 10 located in its lower portion. A second pivot 7 is located between the first pivot 6 and the support base 10. The support base 10 includes a first support surface 18 that is capable of coming in contact with the shell base 2, and a second support surface 19 that is capable of coming in contact with an abutment 24 arranged on the collar 3.

The first pivot 6 is positioned in the vicinity of the upper end E1. The ratio between the distance d1 separating the first pivot 6 from the first end E1 and the distance d4 separating the first pivot 6 from the second end or from the lower end E2 is between 0.15 and 0.35. Preferably, this ratio is between 0.2 and 0.26. In other words, the mathematical equation can be expressed as follows:

$$0.2\times d4<d1<0.26\times d4$$

In the embodiment shown in FIGS. 2 to 5, the ratio between d1 and d4 is substantially equal to 0.23.

Advantageously, due to the small ratio between d1 and d4, ranging between 0.1 and 0.3 or, in a more particular embodiment, between 0.2 and 0.26, the upper end E1, in its movement around the first pivot 6, has an amplitude of movement much lower than that of the lower end E2. As described below, switching the blocking device to the released state generates an outward movement of the end E2, whereas the upper end E1 is actuated by an inward movement. The inward movement of the upper end E1 requires that a corresponding cavity be provided in the collar 3 to enable the end E1 to enter in the collar. Consequently, the small d1/d4 ratio requires the cavity being provided in the collar to be relatively small. Thus, although a boot according to the invention includes a blocking device, the blocking device does not generate any unnecessary volume, and it can blend well in the general appearance of the boot.

Figure 4:
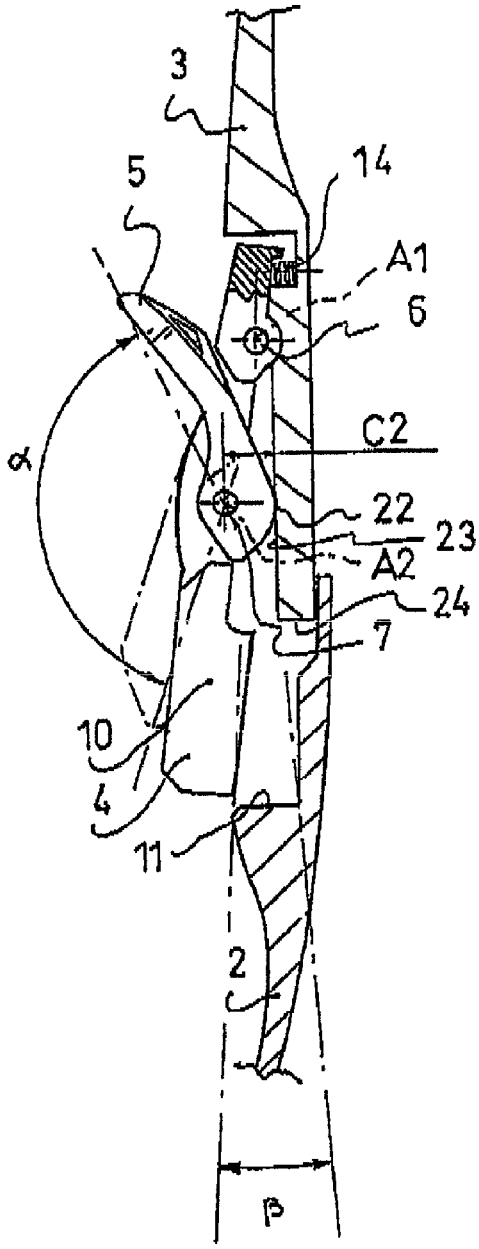
FIG. 4 is a cross-sectional side view of the blocking device of the boot of FIG. 1, when it is in the release state.

The support base 10 of the rocker includes a first support surface 18, which merges with the second end E2, as well as a second support surface 19 in the blocking state. The first support surface 18 is in contact with an edge 11 arranged in the shell base 2, whereas the second support surface 19 is in contact with an abutment 24 arranged in the lower portion of collar 3. The support base 10 occupies a projecting position with respect to the remainder of rocker 4. Thus, it can easily become wedged between the abutment 24 of the collar and the edge 11 of the shell base. As shown in FIGS. 2 and 4, the edge 11 is a generally upward facing surface and the abutment 24 is a generally downward facing surface.

In the "SKIING" position, when the user needs rear support, the forces transmitted between the collar 3 and the shell base 2 are transmitted mainly through contact surfaces, which include the abutment 24 and the second support surface 19, on the one hand, and the edge 11 and the first support surface 18, on the other hand. A proportion of these forces can also pass through the second pivot 6. In order to limit this proportion, one can provide for the first pivot 6 to have a vertical play.

The second pivot 7 is located between the support base 10 and the first pivot 6, i.e., between the second support surface 19 and the first pivot 6. The lever 5 is pivotally mounted around the second pivot 7. The second pivot 7, which also takes the form of a metal rod or a rivet, or any other known expedient, is oriented along an axis A2.

The lever 5 is in the form of a crampon extended by a manipulatable part, shown in the drawing in the form of a plate 13 that is used for its actuation by a user. The two arms 25 of the lever are positioned on opposite sides of the rocker 4. Each of the arms 25 is bored with an opening provided to receive the second pivot 7, and each of their external surfaces constitutes a cam surface 26 provided to come in contact with a rolling surface arranged on the collar 3. As shown in the drawing, each of the cam surfaces 26 is a surface of the lever itself, i.e., the cam surfaces and the manipulatable part are unitary with the lever, i.e., the cam surfaces simultaneously move with the remainder of the lever 5.

The blocking device also includes a return mechanism 14 provided to return the lower portion of the rocker 4, i.e., the support base 10, against the boot. In the embodiment illustrated in FIGS. 2 to 5, the return mechanism 14 is in the form of one or more springs working in compression, positioned in the area of the end E1.

The cam surface 26 arranged on each arm 25 has a first portion 21, which is at a distance C1 from the second pivot 7, and a second portion 22, which is at a distance C2 from the second pivot 7. In the illustrated embodiment, the distances C1 and C2 are different, the cam surface 26 therefore constituting an eccentric cam surface, i.e., the distance between the surface 26 and the second pivot 7 varyies as it extends therearound. When the blocking device is in the blocking state, it is the first portion 21 of the cam surface 26 that is opposite the rolling surface 23, arranged on the collar 3.

In the blocking state, i.e., in the "SKIING" position, the lever 5 is pressed against the rocker 4 and closely follows its shape. Thus, there is integration of the lever 5 of the rocker 4 in the continuity of the collar 3 and of the shell base 2.

The rocker 4 is mounted so as to pivot with respect to the collar 3 around the first pivot 6, whereas the lever is mounted so as to pivot with respect to the rocker 4 around the second pivot 7. As will be evident in the following description, the rotation of the lever 5 causes the rocker 4 to pivot by the effect of the cam surfaces 26 arranged on the arms 25. That is, as evident in the illustrated embodiment, rotation of the lever 5 causes the rocker 4 to move in the same direction, which means that if the lever 5 is rotated clockwise, the rocker 4 is caused to move clockwise, and if the lever 5 is rotated counter-clockwise, the rocker 4 is caused to move counter-clockwise.

Figure 5:
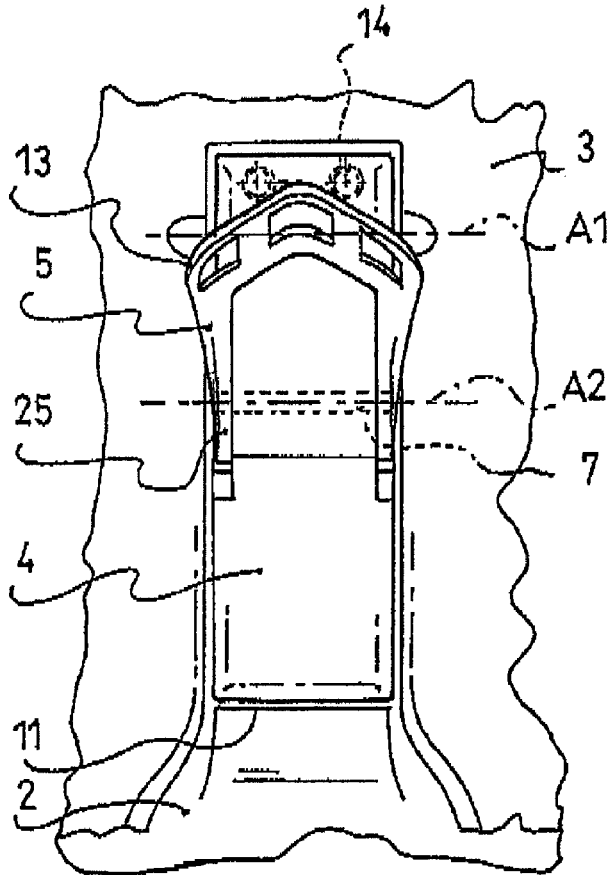
FIG. 5 is a rear view of the blocking device of the boot of FIG. 1, when it is in the release state.

FIGS. 4 and 5 illustrate the aforementioned boot in the release state, i.e., in the "WALKING" position. In this state, the rocker 4 is pivoted around the first pivot 6 such that its lower end E2 is moved towards the outside of the boot 1. The rotational movement of the rocker 4 must have an amplitude such that the tip 28 of the rocker is no longer opposite the edge 11. As can be seen in FIG. 4, the movement of the tip 28 of the rocker is defined by the straight line separating the first pivot 6 from the tip 28 of the rocker in the blocking position and in the release position. The amplitude of this movement corresponds to an angle β whose value is between 3° and 25° or, in a particular embodiment, between 5° and 15°. In the example shown, β is between 8° and 10°.

In the released state, the abutment 24 of the collar and the edge 11 of the shell base are free for relative movement with respect to one another, and they can come closer to one another. There is no more rear support. That is, in the released state no rear support force is transmitted to the shell base. It is then easier to walk; due to the absence of rear support, the user can place the foot flat in front of him/her.

The rotational movement of the rocker 4 is generated by the user's action on the lever 5. The lever is shown in FIG. 5, when the blocking device is in the released state. The switch from the blocking state to the release state is made when the user manipulates the plate 13 of the lever 5 upward. The rotational movement of the lever 5 around the second pivot 7 is a movement whose amplitude is defined in FIG. 4 by a straight line connecting the second pivot 7 and the tip 27 of the lever in the two positions. The amplitude of this movement corresponds to an angle α, which is between 90° and 160° or, in a particular embodiment, between 120° and 150°. In the example shown, α is substantially equal to 135°.

In the released position, it is the second portion 22 of the cam surface 26 that is in support against the rolling surface 23.

The invention is not limited to the particular embodiments described herein, which are presented by way of example, but it encompasses all equivalent embodiments.

The invention claimed is:

1. A boot comprising:

a shell base;

a collar;

an articulation between the collar and the shell base configured and arranged to allow movement of the collar with respect to the shell base about the articulation, said movement being at least substantially perpendicular to a longitudinal axis of the boot; and a device for blocking the rearward rotation of the collar with respect to the shell base, said device comprising:

a rocker mounted to rotate with respect to either the collar or the shell base, around a first pivot, said first pivot being oriented along a first axis and said rocker having an elongated shape extending between an upper end and a lower end, and said first pivot being positioned in a vicinity of one of the upper and lower ends;

a support base, positioned in a vicinity of another of the upper and lower ends, said support base comprising a first support surface capable of coming in contact with either the shell base or the collar; and a lever mounted to rotate with respect to said rocker around a second pivot, said second pivot being oriented along a second axis, parallel to said first axis, and said second pivot being positioned between said first pivot and said support base, said lever comprising a user-manipulatable part and a cam surface, the user-manipulatable part being engageable by the user for actuating the blocking device to at least either of two states.

2. A boot according to claim 1, wherein:

said rocker is rotationally mounted on said collar;

said first pivot is positioned in a vicinity of the upper end; and said support base is positioned in a vicinity of the lower end.

3. A boot according to claim 1, wherein:

said blocking device is capable of being in at least a blocking state or a released state;

in said blocking state said blocking device blocks rearward rotation of the rotational movement of the collar with respect to the shell base;

in said released state, said rear rotation is not blocked.

4. A boot according to claim 3, wherein:

said blocking device further comprises a return mechanism, said return mechanism including at least one spring configured and arranged to exert a force to return said blocking device to the blocking state.

5. A boot according to claim 3, wherein:

said lever enables the blocking device to switch from the blocking state to the released state;

said cam surface includes a first portion located at a first distance from said second pivot, a second end portion located at a second distance from said second pivot when the plate of said lever is actuated in rotation by the user by an amplitude that corresponds to an angle α whose value ranges between 120° and 160°, whereby:

$$120° < \alpha < 160°.$$

6. A boot according to claim 2, wherein:

said first support surface of said support base corresponds to said other of the upper and lower ends; and a ratio between a distance d1 separating the first pivot from the first end and a distance d4 separating the first pivot from the second end ranges between 0.15 and 0.35, whereby:

$$0.1 \times d4 < d1 < 0.3 \times d4.$$

7. A boot according to claim 1, wherein:

a ratio between a distance d2 separating the first pivot from the second pivot, and a distance d4 separating the first pivot from the lower end ranges between 0.2 and 0.5, whereby:

$$0.2 \times d4 < d2 < 0.5 \times d4.$$

8. A boot according to claim 1, wherein:

said rocker is pivotable between a blocking position and a released position;

in said blocking position of said rocker, during rearward rotational movement of the collar, said first support surface comes into contact with a edge of the shell base;

in said released position of said rocker, said rocker does not block rearward rotation of the collar; and an amplitude of rotational movement of the rocker corresponds to an angle β whose value is as follows: $3° < \beta < 25°$.

9. A boot according to claim 1, wherein:

said rocker is pivotable between a blocking position and a released position;

in said blocking position of said rocker, during rearward rotational movement of the collar, said first support surface comes into contact with a edge of the shell base;

in said released position of said rocker, said rocker does not block rearward rotation of the collar; and an amplitude of rotational movement of the rocker corresponds to an angle β whose value is as follows: $5° < \beta < 15°$.

10. A boot according to claim 1, wherein:

said support base includes a second support surface configured and arranged whereby, when the blocking device is in the blocking state, the second support surface is capable of being in contact with an abutment arranged on the collar.

11. A boot according to claim 1, wherein:

the user-manipulatable part is an actuating plate for actuating the device selectively between the two states, the two states being a blocked state and a release state.

12. A boot according to claim 1, wherein:

the lever and the rocker are structured and arranged so that rotation of the lever around the second pivot in a direction causes the rocker to rotate about the first pivot in said direction.

13. A boot according to claim 12, wherein:

said direction of rotation of the lever and rocker to place the boot in a configuration for said blocking the rearward rotation of the collar is upward about the second and first pivots, respectively.

14. A boot according to claim 12, wherein:

the user-manipulatable part and the cam surface are unitary with the lever.

15. A boot according to claim 1, wherein:

the cam surface is in engagement with a surface arranged on the collar.

16. A boot according to claim 1, wherein:

the cam surface is an eccentric cam surface.

17. A boot according to claim 16, wherein:

the blocking device is structured and arranged to be selectively configured in a blocking state and a release state;

in the blocking state, the cam surface engages with a rolling surface at a first distance from the second pivot;

in the release state, the cam surface engages with the rolling surface at a second distance from the second pivot, the second distance being greater than the first distance.

18. A boot according to claim 17, wherein:

the rolling surface is a surface arranged on the collar.

19. A boot according to claim 1, wherein:

one of the upper and lower ends of the rocker is elastically biased to rotate in a first direction around the first pivot toward the boot;

the lever is structured and arranged to move in a second direction around the second pivot to move the one of the upper and lower ends of the rocker in said second direction around the first pivot.

20. A boot according to claim 1, wherein:

one of the two states of the blocking device is a release state;

no rear support force is transmitted from the collar to the shell base in the release state.

21. A boot comprising:

a shell base;

a collar;

an articulation between the collar and the shell base configured and arranged to allow movement of the collar with respect to the shell base about the articulation, said movement being at least substantially perpendicular to a longitudinal axis of the boot; and a device for blocking the rearward rotation of the collar with respect to the shell base, said device comprising:

a rocker mounted to rotate with respect to either the collar or the shell base, around a first pivot, said first pivot being oriented along a first axis and said rocker having an elongated shape extending between an upper end and a lower end, and said first pivot being positioned in a vicinity of one of the upper and lower ends;

a support base, positioned in a vicinity of another of the upper and lower ends, said support base comprising a first support surface capable of coming in contact with either the shell base or the collar;

a lever mounted to rotate with respect to said rocker around a second pivot, said second pivot being oriented along a second axis, parallel to said first axis, and said second pivot being positioned between said first pivot and said support base, said lever including an actuating plate and a cam surface;

said rocker being pivotable between a blocking position and a released position;

in said blocking position of said rocker, during rearward rotational movement of the collar, said first support surface coming into contact with a edge of the shell base;

in said released position of said rocker, said rocker not blocking rearward rotation of the collar;

an amplitude of rotational movement of the rocker corresponding to an angle $\beta$ whose value is as follows: $3° < \beta < 25°$.

22. A boot comprising:

a shell base;

a collar;

an articulation between the collar and the shell base configured and arranged to allow movement of the collar with respect to the shell base about the articulation, said movement being at least substantially perpendicular to a longitudinal axis of the boot; and a device for blocking the rearward rotation of the collar with respect to the shell base, said device comprising:

a rocker mounted to rotate with respect to either the collar or the shell base, around a first pivot, said first pivot being oriented along a first axis and said rocker having an elongated shape extending between an upper end and a lower end, and said first pivot being positioned in a vicinity of one of the upper and lower ends;

a support base, positioned in a vicinity of another of the upper and lower ends, said support base comprising a first support surface capable of coming in contact with either the shell base or the collar;

a lever mounted to rotate with respect to said rocker around a second pivot, said second pivot being oriented along a second axis, parallel to said first axis, and said second pivot being positioned between said first pivot and said support base, said lever including an actuating plate and a cam surface;

said rocker being pivotable between a blocking position and a released position;

in said blocking position of said rocker, during rearward rotational movement of the collar, said first support surface coming into contact with a edge of the shell base;

in said released position of said rocker, said rocker not blocking rearward rotation of the collar;

an amplitude of rotational movement of the rocker corresponding to an angle $\beta$ whose value is as follows: $5° < \beta < 15°$.

* * * * *